US008629606B2

(12) United States Patent
Kákonyi

(10) Patent No.: US 8,629,606 B2
(45) Date of Patent: Jan. 14, 2014

(54) LIQUID ANODE RADIATION SOURCE

(75) Inventor: Róbert Kákonyi, Kalocsa (HU)

(73) Assignees: GE Hungary KFT. (HU); University of Szeged-South-Lowland Cooperative Research Center of Life Science and Materials Science (HU)

( * ) Notice: Subject to any disclaimer, the term of this patent is extended or adjusted under 35 U.S.C. 154(b) by 236 days.

(21) Appl. No.: 13/304,585

(22) Filed: Nov. 25, 2011

(65) Prior Publication Data

US 2012/0133265 A1 May 31, 2012

(51) Int. Cl.
*H01J 35/08* (2006.01)
*H01J 35/04* (2006.01)

(52) U.S. Cl.
USPC ..... 313/163; 313/328; 378/143

(58) Field of Classification Search
USPC ..... 313/163, 328; 378/143
See application file for complete search history.

(56) References Cited

U.S. PATENT DOCUMENTS

| | | | | |
|---|---|---|---|---|
| 4,953,191 | A * | 8/1990 | Smither et al. | 378/143 |
| 6,477,234 | B2 * | 11/2002 | Harding et al. | 378/141 |
| 6,961,408 | B2 * | 11/2005 | Harding et al. | 378/143 |
| 7,412,032 | B2 * | 8/2008 | Harding | 378/125 |
| 2004/0156475 | A1 * | 8/2004 | Hatanaka et al. | 378/143 |

* cited by examiner

*Primary Examiner* — Karabi Guharay
*Assistant Examiner* — Nathaniel Lee

(57) ABSTRACT

The present disclosure relates to a liquid anode radiation source (10) having the ability of turning upside down. The liquid anode radiation source (10) comprises a body (12) equipped with inlet and outlet having a wall (15) limiting the anode space (17), where the outlet connected to the inlet outside the body (12) will define a continuous flow path closing through the body, the inlet has a wall limiting an internal cross-section changing towards the anode space (17), wherein the cross-section of the inlet a deflector (11) is arranged in a position free of contacting the wall, filling out the cross-section partially and movable to the direction perpendicular to the cross-section; the liquid anode material (14) arranged in the flow path; the circulation unit inserted in the flow path in such a way that it can ensure the unidirectional movement of the anode material in the flow path.

20 Claims, 5 Drawing Sheets

LIQUID ANODE RADIATION SOURCE

CROSS-REFERENCE TO RELATED APPLICATIONS

This application claims the benefit of a foreign priority patent application filed in Hungary as Application No. P 10 00635, filed on Nov. 26, 2010, the entirety of which is incorporated herein by reference.

BACKGROUND OF THE INVENTION

This disclosure relates generally to X-ray radiation sources, and more particularly to a liquid anode radiation source.

The various imaging technologies constitute an accepted and integral part of our everyday life. Applying various types of high-intensity radiation sources (e.g. neutron sources, X-ray sources, etc.) these imaging technologies are widely used in non-destructive quality control (see the neutron diffraction material structure testing methods), security engineering (see airport radioscopic screening) or medical diagnostics.

The imaging technologies based on the use of X-rays constitute a significant group of medical imaging technologies, including but not limited to for example computer tomography (CT) or μ-CT, as well as various methods of radiography and mammography. For these diagnostic methods, the part from 1 to 300 keV photon energy of the electro-magnetic radiation is used which is usually produced by means of an X-ray tube. The X-ray beam is practically produced in such a way that the electron beam of appropriate energy is set on a specific region (the focal spot) on the internal metal surface of the X-ray tube, called the anode. The electrons impacting the material of the specific region of the anode are slowed down within a very short time as a result of which one part of their kinetic energy forms X-ray radiation, while the other part (more than 99%) is used for the warming of the anode in the form of heat.

The warming of the anode significantly influences the amount of the tube current to be applied in the X-ray tube, as well as for a given tube current the smallest size of the mentioned focal spot in the case of use when the solid anode will not yet melt. If the anode is overheated, then it will result in the melting of the anode material in the focal spot and the anode surface in the focal spot will become uneven. Because of this, the intensity of the X-ray radiation coming from the focal spot will decrease. In order to eliminate or reduce the problem caused by warming of the anode, the anode of solid material anode X-ray tubes are made of metals having very high melting points, usually wolfram (W) or molybdenum (Mo) on a design that turns around an axis in order for the heat load on the anode to distribute on a greater surface.

For imaging, proper detection of the information carrier (for example, the X-ray beam coming out of the system to be diagnosed) is necessary. The detectors serving this purpose are known to professionals. For taking an image of proper quality, that is, for detecting with the required noise level, it is necessary to ensure exposure of a given extent on the detector. The combination of the required exposure and the exposure time characteristic of the irradiation of the system to be diagnosed will determine the minimum tube current to be used for the X-ray tube. The exposure of the detector is directly proportional to the product of the tube current and the exposure time. In order to reduce the extent of artifacts resulting from displacement to the minimum possible level, it is a general aim that the required exposure is reached within the shortest possible exposure time. For example, in CT applications the exposures necessary for taking each projection can be achieved on the detector in order to ensure the given image quality through the application of great tube current with small exposure times. So for a solid material anode X-ray tube operating with a focal spot of given (effective) size (usually of 0.3-1.0 mm diameter), the tube current connected to the X-ray tube has a definite maximum for avoiding the melting of the anode. If greater tube current is applied, then the anode material will melt at the focal spot. Accordingly, the melting of the anode material at the focal spot will define the shortest realizable exposure time, which is unfavorable for imaging.

Therefore, if we want to increase the maximum tube current of an X-ray tube, then we should increase the (effective) size of the focal spot. It is understood that in this case, the distance of the focal spot from the detector will also be increased in order for the contrast and spatial resolution of the image taken with the detector can be maintained. It will result in the increase of the external dimensions of the actual diagnostic imaging equipment. In other words, when the imaging equipment is operated with a given resolution, the increase of the focal spot in a given proportion and the increase of the distance of the X-ray tube focal spot from the object to be diagnosed in the same proportion will not result in the modification of the exposure affecting the detector.

To summarize, the real parameter characterizing the "goodness" of the imaging equipment containing a solid material anode X-ray tube (that is their image quality, efficiency, safety, etc. with a given radiation load) is the maximum value of the X-ray tube current falling on the unit area of the focal spot or in other words the maximum current density measured on the focal spot.

Attempts were made for replacing the solid material anode of X-ray tubes. For example, U.S. Pat. No. 4,953,191 describes an X-ray source which bombs liquid (that is melt) gallium flowing on a vertical plane metal plate with a source beam and in this way produces X-ray radiation. Prior to impacting the liquid gallium with proper speed, the source beam is led through a high-voltage accelerating space. The metal plate of the X-ray source serves for maintaining and stabilizing the flowing gallium. The movement of the liquid gallium takes place on the vertical plane metal plate, so the stabilization of the gallium stream is done on a plane surface. Consequently, the X-ray source operates only in vertical, standing position in order to prevent the gallium from "sliding down" the metal plate. The liquid gallium is kept in continuous motion that is circulated in the X-ray source by means of an electromagnetic pump. The problem of gallium entering the accelerating space is not solved, so the operability of this liquid anode radiation source is doubtful.

U.S. Pat. No. 5,052,034 discloses an X-ray source having an anode constituting the source of X-ray radiation in the form of a liquid metal on a plane-surface anode holder. For the solutions considered, the anode holder is expediently covered with gallium (Ga), indium (In), tin (Sn), or alloys of these metals. The flowing off of the liquid metal from the anode holder is prevented by the surface forces (surface tension) acting between the particles of the liquid metal and the particles of the anode holder found on the surface of the anode holder. The supply of the liquid anode material on the anode holder is provided through the condensation of the evaporating anode material. Since the surface forces are of a restricted amount, this solution practically requires the use of a horizontal anode holder. Even to a small-extent, canting of the X-ray source (and thus the anode holder) will result in the outflow of the liquid anode material from the anode holder and thereby the termination of the production of X-ray radiation. It is a further disadvantage that the flowing back of the liquid anode material into the accelerating space realized in the form of high-voltage vacuum space may easily occur which may result in the failure of the X-ray source. In another proposed solution, the (low steam-pressure) metal constituting the liquid anode is kept in continuous flow by means of a Faraday pump in a self-contained channel formed in insulation material. The bombing of the liquid anode with electrons takes place in a section of the mentioned channel in which the liquid anode material flows on a plane surface, with itself also being spread on a plane. The source beam is produced by means of a cathode placed in an airtight space separated from the anode material.

In order to avoid the problem of the anode material getting into the accelerating space of the electrons constituting the electron beam, the mechanical separation of the accelerating space and the liquid anode material by means of a sufficiently thin separation window may give a solution.

U.S. Pat. No. 6,185,277 treats such an arrangement where the high-voltage vacuum space is separated from the liquid anode by a thin electron window made from suitable material. There is a restriction placed in the liquid flow below the window. Under the influence of the restriction, the flow of the liquid anode material below the window will become turbulent, improving the cooling of the window. Cooling of the window is considered in U.S. Pat. No. 6,477,234. According to the '234 patent, the flow of another liquid is led before the window serving the introduction of the source beam, which will achieve the increased cooling of the window concerned by carrying away one part of the heat produced in the window under the influence of the source beam passing through it. Further liquid anode X-ray sources achieved with electron window are disclosed in U.S. Pat. Nos. 6,925,151 and 6,961,408. The considered solutions do not eliminate, only reduce the problem of electron window warming. As a result, such a relatively thin electron window is subject to fatigue fracture owing to the accumulated thermal and mechanical stress, as it is mentioned by U.S. Pat. No. 7,412,032 and thus, it may lead to the unforeseen failure of the X-ray source. In addition, the integration of such windows in the X-ray sources will increase the complexity of the manufacturing processes and production costs of liquid anode X-ray sources.

Therefore, there exists a need for an improved liquid anode radiation source that can operate in an optional direction in any orientation that the liquid anode radiation source has the ability of turning "upside down".

BRIEF DESCRIPTION OF THE INVENTION

In the light of the above, the purpose of this disclosure is to produce a radiation source having a mechanically stabilized liquid anode, especially an X-ray or neutron source, which is operable independently of its orientation, meaning it can emit radiation continuously as required under the influence of a source beam impacting the liquid anode material at the focal spot.

Beyond this, this disclosure discloses the implementation of a source which can eliminate the above-treated disadvantages of liquid anode radiation sources produced with a separation window. Especially, the purpose is to develop a liquid anode radiation source which has optional orientation, free anode surface from the direction of the arrival of the source beam, which prevents the contamination of the high-voltage accelerating space serving for the production of the source beam with anode material.

The basis of the present disclosure is to form the holder of the liquid anode material as the concave region of the internal surface of a chambered element forming a body equipped with inlet and outlet, and flow the anode material continuously at properly regulated speed on this internal surface from the inlet to the outlet in the direction of its arch, then inertial forces will effect on the part of the anode material just flowing through the concave region of the surface, which will press the anode material to the surface and simultaneously stabilize it without the use of any further mechanical limiting part. The internal surface of the applied chambered body will form a barreled surface especially at least on one part, and the flow will take place along the longitudinal generators of this barreled surface. The bend characterizing the arch of these considered generators has to be selected sufficiently great for the inertial pressing force of due amount to be able to affect the anode material of laminar flow with all the values of the flow rate range planned in the operational condition. After the extent of the bend is fixed by the manufacture of the chambered element, the amount of the inertial forces come into play during the operation of the radiation sources, as per the disclosure as well as the spreading thickness of the anode material related to the surface can be regulated by changing the anode material flow rate. The flow rate can be adjusted for example by means of suitable pumps. In order to ensure continuous anode material flow, the free ends of the inlet and outlet join in storage buffer tank(s) which store the liquid anode material are advantageously equipped with cooling. In the event of the application of several tanks, the individual tanks communicate with each other (e.g. through suitable conduit(s)) in order to achieve a closed liquid circuit. For such an embodiment, the cooling of the flowing anode material can be achieved or increased by leading conduit(s) through a suitable heat exchanger. The liquid anode thickness can be modified by changing the amount of the inertial forces coming into play during operation. Since the source beam falls on the free surface of the liquid anode (that is the surface opposite the internal surface of the chambered element), for the emission from the radiation source as per the disclosure the radiation produced must pass also through the anode material. In accordance with this, by the regulation of the spreading thickness of the anode material an effective integrated filtering element will also be achieved: the lower limit of the energy of the radiation emitted from the radiation source as per the disclosure can be adjusted and modified optionally by the value of the spreading thickness, even during the operation of the radiation source. The filtering characteristics can be modified further by the modification of the wall of the chambered element in the direction of the emitted radiation as required (e.g., by thinning or thickening it or possibly applying material of different mass number). In addition, further filtering elements having the required filtering characteristics can also be arranged along the external surface of the wall in the way of the emitted radiation. It means that by maintaining the anode liquid on the surface without using any additional mechanical element we have also achieved an integrated radiation filter of dynamically adjustable characteristics.

A further advantage of the radiation source(s) of the present disclosure is that efficient anode material condensation can be realized as a result that the anode material flow practically takes place on the whole internal surface of the chambered element forming their body: the returning to liquid phase of the anode material evaporated on the anode focal spot by the source beam is supported by a relatively large condensation surface. In addition, the large condensation surface makes it possible for the heat energy produced during the particle impacts to spread on great amount of the anode material and thereby the heat load and the possibility of the cooling of the radiation source will improve.

More specifically, the above-mentioned advantages of the present disclosure have been achieved by a liquid anode radiation source in which the flow path of the liquid metal constituting the anode is an arched, barreled surface at least in one section and the inertial forces affecting during the movement will press the anode material onto this surface. For the proposed radiation sources, the anode space containing the liquid anode and the high-voltage accelerating space communicate with each other and they are not separated by a separation window which can transmit the source beam but constitutes mechanical hindrance for the vapors of the liquid anode. So the surface of the anode is free in the direction of the spreading of the source beam; in the way of the source beam there is no separation window exposed to thermal and mechanical stress. For the radiation sources of the present disclosure, the required separation of the anode material and the high-voltage accelerating space are accomplished by the application of the anode material trap achieved with a suitable static electric field.

In addition, for certain embodiments of the radiation source(s) of the present disclosure, the flow of the liquid anode material in the radiation source is supported by an electromagnetic pump or Faraday pump arranged advantageously at the outlet serving for the discharge of the anode material from the body surrounding the anode space. Through the application of the Faraday pump, it can be prevented that the anode material flows back into the body (the anode space) through the outlet in certain orientation of the radiation sources (e.g., in their "upside down" position) and accumulating.

Furthermore, the special geometry of the Faraday pump applied advantageously will also contribute that the flow of the liquid anode material can be stabilized at the outlet.

Various other features, aspects, and advantages will be made apparent to those skilled in the art from the accompanying drawings and detailed description thereof.

BRIEF DESCRIPTION OF THE DRAWINGS

Hereinafter we will describe the invention in details with reference to the attached drawing, where.

DETAILED DESCRIPTION OF THE INVENTION

Figure 1:
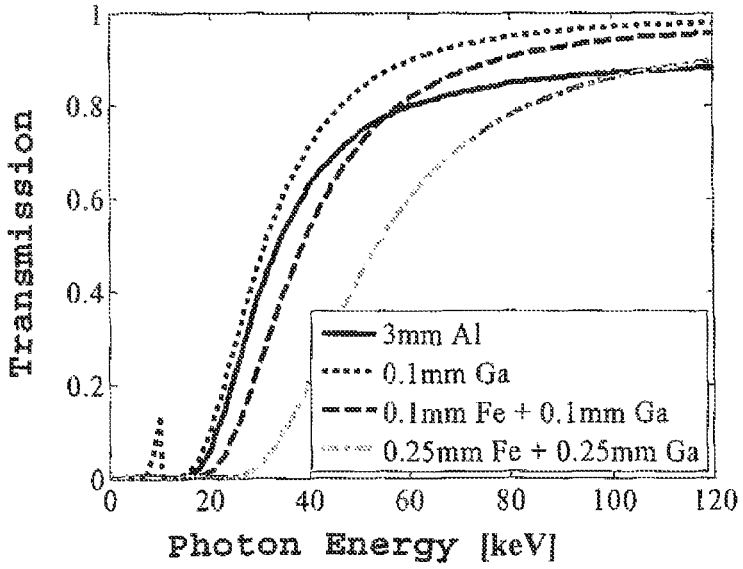
FIG. 1 is a graph showing the transmission of X-ray radiation as a function of photon energy for various types of anode material and thicknesses.

The similar reference numerals used in the drawings will practically refer to the same unit in each case. In addition, for the sake of simplicity, the flow path of the liquid anode material in the drawings in each case with flow lines running in parallel with the body wall.

Hereinafter we will describe in more detail the various embodiments of a radiation source of the present disclosure, specifically in connection with various embodiments of a liquid anode X-ray radiation source.

Referring now to the drawings, FIG. 1 shows transmission of X-ray radiation calculated by the Beer-Lambert principle as a function of the energy of the X-ray radiation that is the photon energy for anode material produced from e.g., liquid gallium (Ga) layered on each other in various thicknesses and solid metal material of specified quality, especially steel (Fe). From FIG. 1, it can be seen that the transmission can be influenced by changing the thickness of the liquid Ga and the solid Fe separately and also in combination with each other. In a geometrical arrangement where Ga is flowing in the form of a layer of specified thickness on an Fe surface of given thickness and the specified size selected area of this flowing Ga layer serve as anode focal spot (i.e., source beam of given energy impacts it continuously or intermittently in time); the energy spectrum of the X-rays coming out from the anode focal spot to any direction of the space and especially the X-rays leaving through the Fe surface can be controlled continuously by modifying the thickness of the Ga layer. Therefore, a liquid anode X-ray source having a dynamic filtering effect can be achieved by means of specific arrangement. We note that the characteristics of a filter produced by an approx. 0.1 mm thick Ga layer with good approximation is the same as the characteristics of the filter established in the form of an approx. 3 mm thick aluminum (Al) layer, which equals to the internal filtration of the X-ray tubes applied nowadays. It means that by changing the thickness of the Ga layer around this value, filter characteristics similar to those of current X-ray tubes, so the radiation sources of the present disclosure serving for production of X-ray radiation can be applied instead of or in the place of the X-ray tubes applied at the moment without any significant change and/or other accessories.

In addition, if beyond this at least one section of the mentioned Fe surface has also a bend of a given degree in the direction of the liquid Ga flow, then the liquid Ga will flow in the region having a bend of the Fe surface under the effect of inertial forces which will press it onto the considered surface. As a result, the orientation of the liquid anode X-ray source achieved with such geometry to the extent defined by the considered bend of the Fe surface, the speed of the flowing Ga layer and its "sticking" on the Fe can be changed without the interruption of the X-ray's coming out of the anode focal spot. Especially, in the event of the appropriate combination of the mentioned parameters, a continuously operating liquid anode X-ray source can be achieved, which can operate in a stable way even in an "upside down" position (turned 180° to its regular orientation). In accordance with the present disclosure, the X-ray source can be applied in an imaging system where the X-ray source travels on an arched path during imaging and its position to the vertical plane changes in time. In an exemplary embodiment, a neutron beam may pass through liquid lead (Pb) layered on a metal material (e.g., high-melting-point Fe can also be characterized with similar transmission characteristics).

Figure 2:
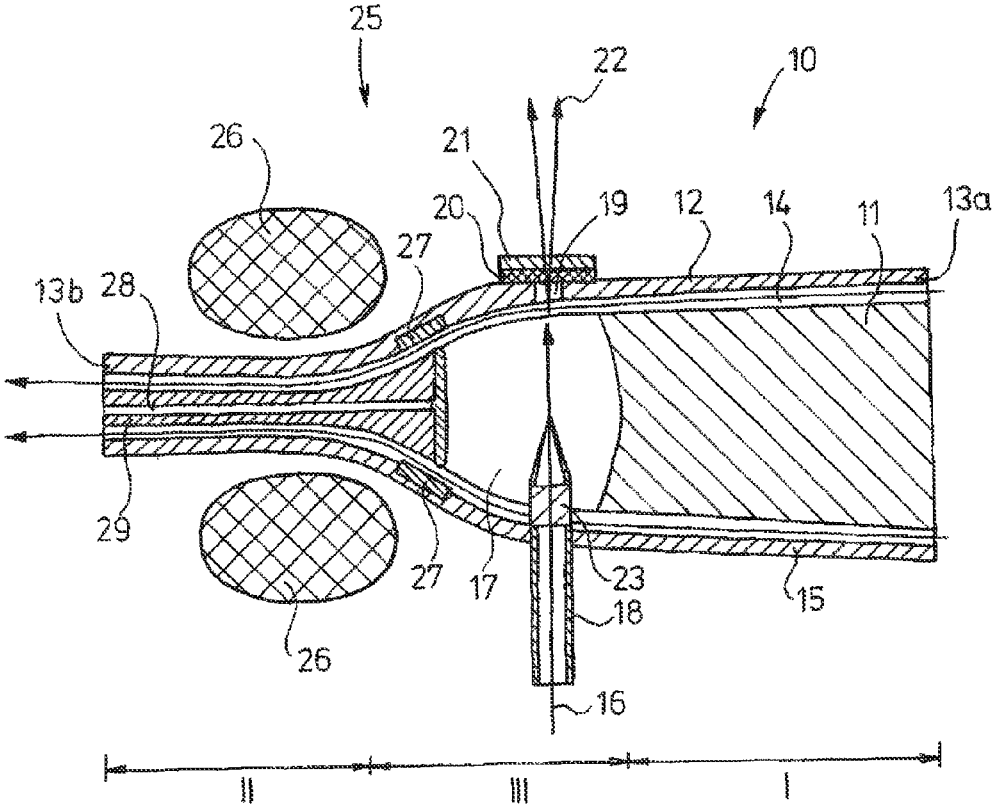
FIG. 2 is a cross-sectional view of an exemplary embodiment of a liquid anode radiation source equipped with a Faraday pump.

FIG. 2 shows an exemplary embodiment of a liquid anode X-ray source 10 of the radiation source. The X-ray source 10 can be operated in any orientation to the vertical. In this document, the term "vertical" means the direction of the resultant gravity field appearing in the place of the X-ray source 10. The X-ray source 10 principally comprises three main parts: a circulation unit holding the liquid anode material 14 in continuous circulation in the flow path achieved by means of properly closed liquid circuit (not shown), a chambered element constituting the body 12 of special geometry inserted in the flow path in a liquid-tight way for forwarding the anode material 14, as well as an exciting unit 18 irradiating through its outlet opening 18*a* the considered region of the anode material 14 with the source beam 16 in order to generate X-ray photons in the specified region of the anode material (anode focal spot). For a preferred embodiment, the X-ray source 10, the anode material 14 is preferably liquid gallium, while different anode materials may also be used. In an exemplary embodiments, gallium, mercury, melt-phase lead, or various gallium or mercury alloys may be used as anode material, while the source beam can be produced as any particle beam having or not having electric charge, including the laser beam, various ionized atom beams, etc.

In addition to the X-ray source 10 having the geometric arrangement described in detail below, further embodiments of radiation sources may also be achieved. For example, if liquid lead is used as an anode material and a proton beam is used with the geometric arrangement to be described (with specific modifications being obvious for a professional), a neutron source may be produced.

Returning now to FIG. 2, the body 12 comprises a chambered element of specified length, preferably cylindrical geometry which has inlet end 13*a* and outlet end 13*b* serving for connection to the liquid circuit, and continuous wall 15 spreading longitudinally between these ends 13*a* and 13*b*. The wall 15 assigns the anode space 17 between the ends 13*a* and 13*b*. The wall 15 is properly made of pressure-resistant and chemically inert material, e.g., stainless steel, although other materials (e.g., ceramics) are also suitable. The connection of body 12 to the liquid circuit by the ends 13*a* and 13*b* will be done by suitable detachable or non-detachable joints (and known per se). The wall 15 comprises region I having the end 13*a*, region II having the end 13*b*, as well as the region III connecting together the regions II and III continuously. The internal cross-section of the considered region I contracts conically starting from the end 13*a*, the internal cross-section of region II is properly permanent or slightly expanding conically towards the end 13*b*, while the region III has an internal cross-section changing in longitudinal direction. For the liquid anode X-ray source 10 in FIG. 2, when travelling from region I towards region II in longitudinal direction, the internal cross section of region III will contract with an arch at least in one section. In other words, the specified section of region III is formed concavely with an arch differing from zero. The considered section will form a retaining surface for the anode material 14, constituting a flow surface ensuring the production of the inertial forces affecting the anode material 14 and pressing it onto the internal surface of the wall 15. The longitudinal size of the regions I and II of body 12 will be selected in such a way that during the operation of the X-ray source 10 the flow of the anode material 14 in these sections can show a stable (laminar) flow pattern which is free of any transient phenomena appearing at the inlet and outlet. In addition, we note that the limits between regions I-III in FIG. 2 are indicated only for illustration; these do not actually mean physical limits.

At the inlet end 13*a* of the body 12, a preferably cylindrical restriction (or torpedo shape) 11 is able to displace longitudinally intrudes to a given depth in the anode space 17 assigned by the wall 15. The restriction 11 is placed in the same axis as the wall 15, keeping a given distance from the wall. As a result of this, a ring-shaped space will be formed between the wall 15 contracted conically in its first region I and the constant-diameter restriction 11, the size of which taken in the cross-section perpendicular to the longitudinal direction depends on the depth of intrusion: the restriction 11 slid into the anode space 17 to a greater depth will create thinner space while the restriction 11 slid into the anode space 17 to a smaller depth will create a wider space. In its position slid to the required depth, the restriction 11 can be fixed in a suitable way, as e.g., for the embodiment shown in FIG. 2, manually. This fixing, however, can be released properly, and then, after adjusting another position creating a space of different width, can be achieved again. For the X-ray source 10, this space will serve for the introduction of the anode material 14 into the anode space 17 and at the same time it will define the spreading thickness of the anode material; the anode material 14 will fill the considered space in its whole width. The restriction 11 is formed properly from a chemically inert material, preferably stainless steel or ceramics. The cross-section of restriction 11 perpendicular to the longitudinal direction may form a plane closed configuration; in the event of a cross-section other than circular, the space between the restriction 11 and the wall 15 will have changing thickness.

A feed-out element achieved in the form of outlet window 19 is placed on the wall 15, in its arched section of region III. The diameter of the outlet window 19 will be selected in accordance with the intended field of application of the X-ray source 10. The filter element 20 covering the outlet window 19 in its full size is fixed onto the external surface of the wall 15. The outlet window 19 has preferably better X-ray penetration ability than the wall 15 material and in an actual case preferably greater thermal load capacity. The outlet window 19 can be properly made from e.g., beryllium. For another possible embodiment, the filter element 20 is formed as an insert element arranged in the thickness of the wall 15. In another embodiment, the outlet window 19 is formed by the narrowed region of the wall 15. The outlet window 19, the applied filter element 20 will serve for feeding the X-ray beams out.

Figure 3:
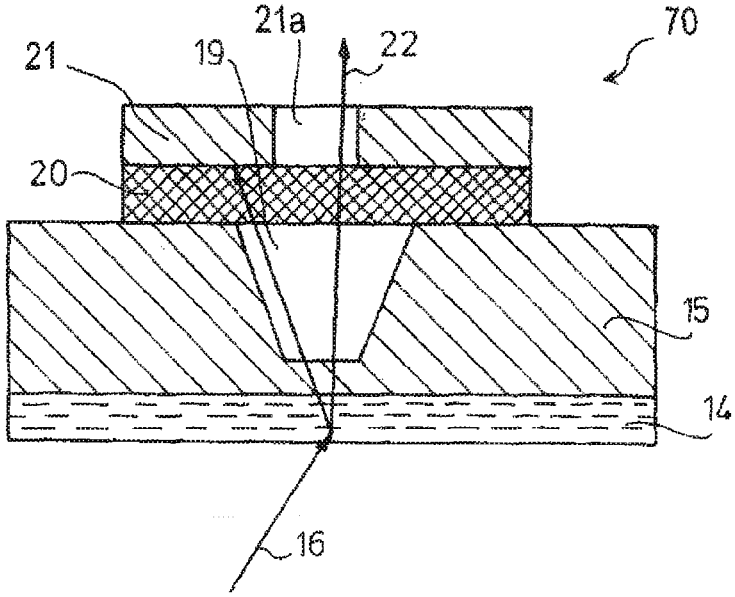
FIG. 3 is a cross-sectional view of an exemplary embodiment of a dynamic filtering element constituting an integral part of the radiation source and exerting its effect in the required energy range.

When viewed in the direction of the thickness of the wall 15, the outlet window 19 can be of constant or changing diameter; in the latter case the outlet window 19 will expand conically when coming out from the anode space 17. The outlet window 19 will also play a role of forming the beam. FIG. 3 shows such an optical feed-out element 70 in enlarged sectional picture for which an element 21 equipped with a small pinhole 21*a* is placed on the filter element 20 in order to further form the X-ray radiation 22 leaving through the outlet window 19 and decrease the effective size of the focal spot. In addition, the pinhole 21*a* can also effectively reduce the scattered character of the X-ray radiation 22. Depending on the application, the filter element 20 may be a single or multiplelayered filter element, and it can also be achieved in a form integrated in one unit with the element 20 equipped with pinhole 21.

For the X-ray source 10 shown in FIG. 2, the exciting unit 18 is established as an element intruding in the anode space 17 through wall 15 of body 12 and achieving a gas-tight closure with wall 15 of body 12. As a result, the exciting unit 18 will communicate freely (that is without the insertion of any electron window) with the anode space 17 through its outlet opening 18*a*. In addition, the outlet opening 18*a* of the exciting unit 18 is arranged in the anode space 17 in such a way that the source beam 16 entering through it can fall practically perpendicularly to the part of the anode material 14 found in the vicinity of the outlet window 19 (that is the focal spot). In this case the source beam 16 is produced in a known way and having a fixed diameter which is supplied by the electron source arranged in the exciting unit 18. In order to avoid anode material vapors produced in the anode space 17 by the source beam 16 impacting the anode material 14 can reach the source of the source beam (in this case the mentioned electron source beam), between the outlet opening 18*a* and the electron beam source, preferably in the vicinity of the outlet opening 18*a*, the exciting unit 18 is equipped with an anode material trap 23 which will be described in details in the following, schematically connected to FIGS. 7A and 7B.

The X-ray source 10 in FIG. 2 is equipped with the electromagnetic pump 25 (a Faraday pump) in the vicinity of outlet end 13*b* of body 12, more precisely on the third arched section, that is region III of the wall 15. The task of pump 25 is to make the anode material 14 stream flowing continuously through the region II unidirectional towards the end 13*b* and stabilize it. The pump 25 comprises at least one magnet 26 placed outside the body 12, at least one middle electrode 28 intruding in the anode space 17 through the second region II and made of an electrically insulating material inserted in the mechanical deflector 29, as well as at least one external electrode 27 inserted in the wall 15 of the body 12 in an electrically insulated way in the narrowing section of the third region III and having electric terminals (not shown). The at least one electrode 28 runs in the deflector 29 on the second region II, then coming out through the outlet end of the deflector 29 viewing towards the anode space 17 is placed on the surface of the end of deflector 29 viewing towards the anode space 17. The at least one electrode 28 can be established e.g., by printing metal conductive layers on the considered end of the deflector 29 or fastening electrically conductive wire(s) mechanically. For another possible embodiment of the X-ray source 10, the at least one electrode 28 is established at the considered end of the deflector 29 in buried position below its surface.

The mechanical deflector 29 is placed in the region II in the same axis as the wall 15, so preferably a ring-shaped channel will be formed between deflector 29 and wall 15 which serves for the discharge of the anode material 14; the anode material 14 will fill the ring-shaped channel in its full width. The end of the deflector 29 viewing towards the anode space 17 has such a geometrical design which will contribute to the passing of the anode material 14 flowing along the wall 15 from region III to region H, and thus to the mentioned outlet. The at least one magnet 26 and the at least one external electrode 27 are arranged symmetrically on the outside of the body 12 and in the wall 15. The at least one magnet 26 may consist of permanent magnet(s) or electromagnet(s).

The general principle and operation of the considered electromagnetic pump 25 are known to professionals skilled in the field; see e.g. R. S. Baker's and M. J. Tessier's "*Handbook of electromagnetic pump technology*" (Elsevier Publisher, ISBN 0444012745, 9780444012746). The pump 25 applied in the X-ray source 10 will move a flow of practically circular-ring cross-section of the anode material 14 in the region III and its vicinity. The schematic drawing of the pump 25 is shown in FIG. 9 in cross-section vertical to the flow direction of anode material 14 flowing in it. FIG. 9 also shows the dynamic quantities helping the stable anode material 14 flowing in the outlet such as the magnetic field strength B characterizing the magnetic field of the at least one outside magnet 26, as well as the i current flowing through the anode material 14 between the at least one middle electrode 28 and the at least one external electrode 27. For the embodiment shown in FIG. 9, one external electrode 27 will properly belong to each of the middle electrodes 27. However, different electrode distribution may also be applied. The electrodes 27 and 28 are established in the wall 15 and at the end of the deflector 29 respectively (advantageously principally opposite each other) in a geometrical arrangement which will ensure that the direction of the i current flowing through the anode material 14 streaming along wall 15 between them and the direction of the magnetic field B are practically perpendicular to each other in the whole flowing cross-section of the anode material. The i currents flowing between the electrodes 27 and 28 belonging to each other can also be controlled separately through the electrodes 28 in a way known to professionals (not shown separately in any drawing) by means of voltage regulator units. We note that if the wall 15 is formed in its marginal area between region H and region III as a passage of special geometry (properly diffuser), the X-ray source 10 can also be achieved with the electromagnetic pump 25 being omitted. Such an embodiment of the radiation source as per the invention is shown in connection with FIG. 8.

The circulation unit includes a (proper outside) pump suitable for ensuring adjustable volume flow. Its dimensioning with the applied anode material 14 (e.g. for the necessary smallest pump performance) is obvious to professionals in accordance with simple thermodynamics (extent of boiling of the anode material under the influence of the source beam) and hydrodynamics (Bernoulli relationship between the pressure and speed of medium of the laminar flow) considerations. Therefore we will not discuss this topic separately.

Operation of the X-ray source 10 illustrated in FIG. 2 will now be described. Following the connection of the body 12 to the closed liquid circuit serving the circulation of the anode material 14, the X-ray source 10 is arranged in an orientation for the start of the flow in which the direction of flow of the anode material 14 is the same as the local direction of the gravity field. This way, the anode material 14 will simply "flow down" on the internal surface of wall 15 and reach the region of the electromagnetic pump 25 also applied in the actual case. Following the production of the low pressure (preferably vacuum) in the anode space 17, the anode material 14 will flow continuously on the internal surface of wall 15 of body 12, so after that the X-ray source 10 can be set in any orientation without the flow of anode material 14 being interrupted. The spreading thickness of anode material 14 in the anode space 17 can be adjusted by setting the volume flow of the circulation unit and the fixation of restriction 11. In order to stabilize the flow of anode material 14, electric voltage of appropriate extent is connected between the middle electrode 28 and the external electrode 27 of the electromagnetic pump 25. As a result, owing to the interaction of the current i flowing through the anode material 14 between the electrodes 27 and 28, and the magnetic field produced by the at least one magnet 26, a dynamic effect stabilizing the flow of anode material 14 will emerge: due to the arched surface of wall 15, inertial forces will affect the anode material 14 running along the third region III of wall 15, which will press the anode material 14 onto the wall 15. During operation, the airtight closure of the anode space 17 necessary for keeping the low pressure in the anode space 17 will be ensured from the inlet end 13*a* by the anode material 14 between wall 15 and restriction 11, while from the outlet end 13*b* by the anode material 14 between the wall 15 and deflector 29.

Following the establishment of the stable laminar flow of the anode material 14 in the anode space 17, the exciting unit 18 begins operation, by which the anode material 14 flowing on the internal surface of the wall 15 will be irradiated in its region found in the vicinity of the outlet window 19 that is the anode focal spot with the source beam 16 of a given energy. In the X-ray source 10 of FIG. 2, an source beam of a given energy for this purpose. In CT and other clinical applications, the energy of the source beam is usually 50-150 keV, preferably 80-140 keV, while it will come typically in the MeV order of magnitude for non-destructive testing methods based on screening.

The energy of the source beam is set in such a way that after passing through anode material 14 and outlet window 19 the shape of the spectrum of X-ray photons produced by it in the anode focal spot can follow a form defined in advance. In other words, the X-ray photons will be filtered jointly by the anode material 14 found in their way as well as the outlet window 19 equipped also with filter element 20 in the actual case. The outlet energy of the X-ray radiation 22 produced by the X-ray source 10 will be selected in a way that no X-ray radiation can leave the area beyond the outlet window 19 (for safety reasons). In order to fully keep the safety regulations, the wall 15, except for the area of the outlet window 19, can be surrounded with suitable sheathing material, e.g., regularly used lead sheath of a given thickness as it is obvious for a professional. It means that the anode material 14 and the wall 15 will completely absorb the X-ray photons beyond the area of the outlet window 19. The material thicknesses necessary for this can simply be defined by taking diagrams similar to the transmission diagrams shown in FIG. 1.

For stopping the X-ray source 10, first switch off the source beam 16 then orientate the X-ray source 10 again in a way that the direction of flow of the anode material 14 is the same as the local direction of the gravity field strength. This way after the switch-off of the circulation unit, the anode material 14 will simply "flow down" on the internal surface of the wall 15 and leave to the flow path or the collector(s) inserted in it.

As compared to the known solutions, one advantage of the X-ray source 10 and thus the radiation sources described in the current disclosure is that a significant part of the heat produced at the moment the source beam 16 impacts the anode material 14 will be used for the boiling of a part of the anode material 14 found in the anode focal spot: the anode material 14 evaporating on the anode focal spot radiated with the source beam 16 will get into the anode space 17 from where, after cooling down, it will condensate back in the anode material 14 flowing on the internal surface of the wall 15. The significant part of the kinetic energy of backscattered electrons from the anode focal spot will also be absorbed by the anode material 14 flowing on the internal surface of the wall 15. This way the anode material 14 kept in continuous flowing will achieve the cooling of the part of X-ray source 10 within the body 12 (e.g. together with the wall 15, the exciting unit 18, the at least one electrode 28 of the pump 25, and the restriction 11), so the body 12 will be exposed in the area of the outlet window 19 to much less thermal and mechanical load as compared to the traditional solutions. As a result, the X-ray source 10 and thus the further radiation sources as per the invention will be practically continuously operating radiation sources.

Figure 4:
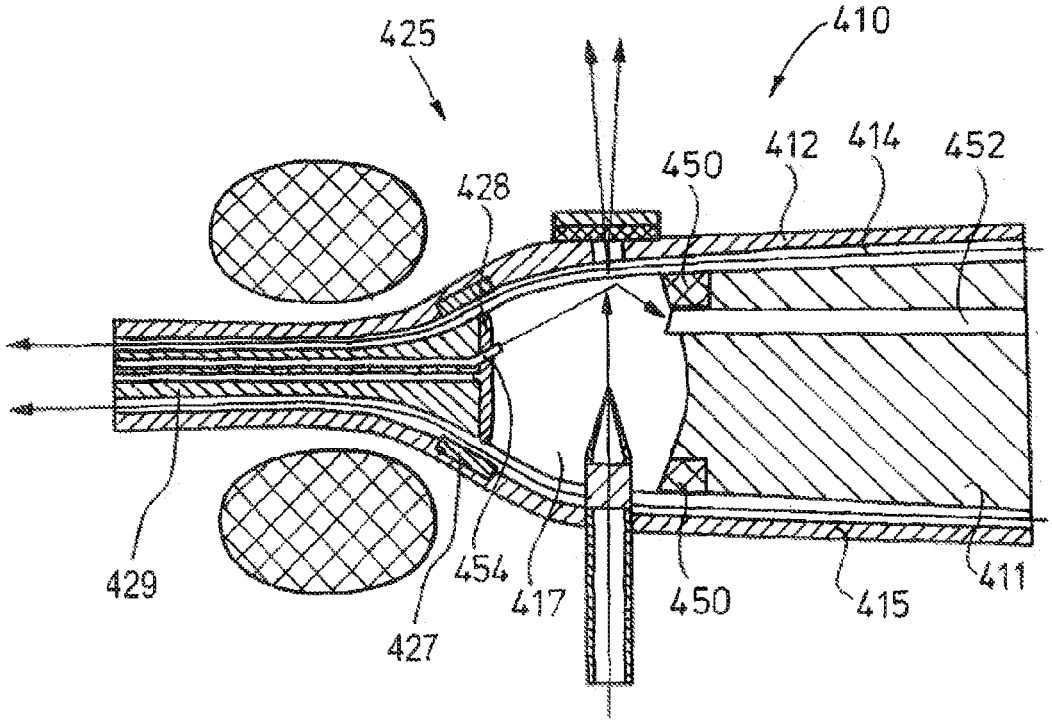
FIG. 4 is a cross-sectional view of an exemplary embodiment of a liquid anode radiation source suitable for the automatic adjustment of the spreading thickness of the liquid anode material connected with the radiation source.

FIG. 4 shows a liquid anode X-ray source 410 which differs from the X-ray source 10 only in that the thickness of the anode material 414 flowing continuously on the internal surface of the wall 415 of body 412 can be changed even during the operation of the X-ray source 410 and/or in an automated way. This way the X-ray source 410 will achieve an X-ray source equipped with a dynamic filter element since the threshold energy of the X-ray photons coming out of the X-ray source 410 can be accurately set by the real-time change between given limits of the thickness of the anode material 414 in the irradiated anode focal spot. Beyond this, the spreading thickness of the liquid anode material 14 can be kept accurately at the required and targeted value even under different operating conditions: especially, the changes occurred in the device as a result of the thermal expansion can be eliminated.

The restriction 411 of the X-ray source 410 is equipped with mechanical actuating elements 450 which will provide for the (automated) displacement of the restriction 411 in longitudinal direction in reply to the electric control signs developed in accordance with the measurement of the thickness change of the anode material 414, as well as for its fixation (interlocking) in the required position and thereby the change of the width of the ring-shaped space produced between the external surface of the restriction 411 and the internal surface of the wall 415 in the appropriate direction (increase, decrease) and extent (amount). The measurement of thickness of anode material 414 can be performed e.g. optically. The light source 454 suitable for emitting properly coherent and monochromatic light placed at the end of the mechanical deflector 429 in the anode space 417 and/or opposite to it on the restriction 411 and constituting part of the X-ray source 410 lighting, preferably the surface of the anode material 414 on the anode focal spot, will create an interference pattern on it, which will be recorded by a detector 452 arranged in a point found on the side of the anode space 417 opposite or the same as the light source 454 (for the embodiment shown in FIG. 4, at the end of the restriction 411 viewing towards the anode space 417), image recording unit properly suitable for it, especially a camera or a CCD chip. By processing the interference pattern, on the basis of its change we can gain information about the shape of the surface of the anode material 414 and at the same time its thickness. The image processing and on the basis of the information obtained, the displacement of the restriction 411 in longitudinal direction by operating the actuating elements 450 will be performed by the electronics suitable for it and placed e.g. in the restriction 411, especially in its volume.

The optical-principle measurement of the thickness of the anode material 414 for another possible embodiment can be achieved also by the measurement of the light intensity. In such a case, the light source 454 can be replaced with any high-intensity light source, while the detector 452 with a quadrant detector known to a professional, so the shape and thickness of the surface of the anode material 414 will be determined from data received with simple light intensity measurement instead of the mentioned record of interference pattern and its image processing for analyzing it. In this case, the electronics will control the displacement of restriction 411 in accordance with the information gained this way. We note that the relationship between the thickness and shape of the anode material 414 and the intensity of the light reflecting from it can clearly be defined by a method known to a professional.

For another possible embodiment of the X-ray source 410, the concerned deflector 429 and thereby the at least one electrode 428 placed on it can also be displaced properly (in accordance with the information gained from the change of the interference pattern or the data received by light intensity measurement), so the change of thickness of the anode material 414 can be followed also by the electromagnetic pump 425; it means that the amount and direction of the magnetic field affecting the anode material 414 as well as the intensity of the current flowing between the external electrode 427 and the middle electrode 428 through the anode material 414 can be modified appropriately in order to maintain the mentioned perpendicular position. Thereby, the flowing stability of the anode material 414 flowing out of the anode space 417 can be improved.

Figure 5:
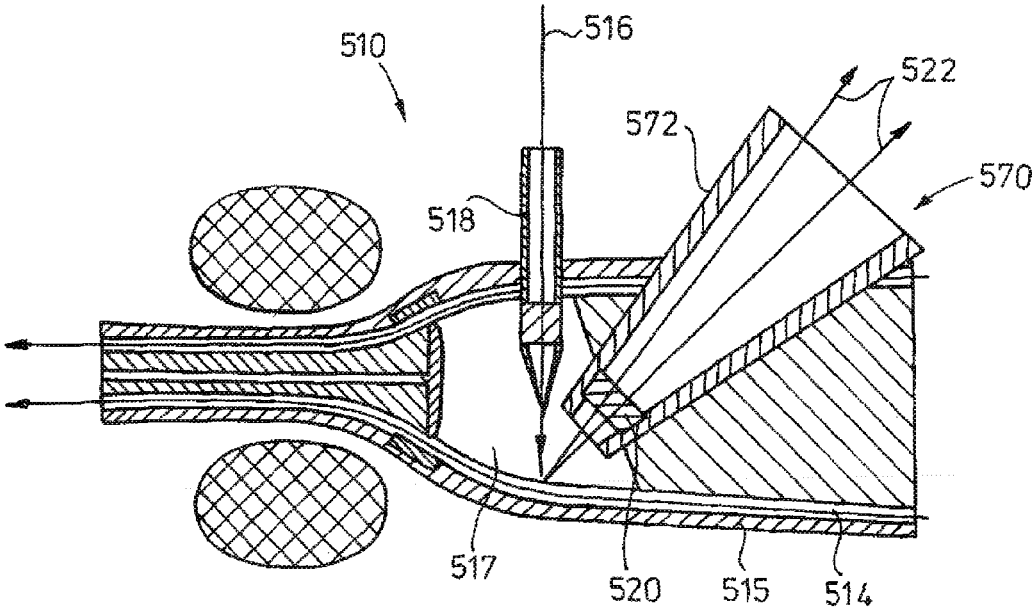
FIG. 5 is a cross-sectional view of an exemplary embodiment of a liquid anode radiation source.

FIG. 5 shows an X-ray source 510 having anode space 517 equipped with anode of liquid anode material 514 which differs from the previously described X-ray sources 10, 410 in that instead of the X-ray photons coming out from the anode focal spot forward in the travelling direction preceding the impact of the source beam 516 impacting the anode material 514, it will utilize the part directing to a given spatial angle interval of the X-ray photons 522 coming out of the anode focal spot into the anode space 517 that is practically backwards. The X-ray source 510 has a separate feed-out element 570 which is formed as an element leading through the wall 515 of the X-ray source 510 and constituting a gas-tight connection with it. The considered feed-out element 570 is preferably a tapered element, which will allow the outlet of the X-ray photons 522 of just the required orientation and travelling in just the required spatial angle interval by that its curved surface 572 is made of a material highly absorbing the X-ray photons impacting it. In order to filter the discharged X-ray photons 522 to a given threshold energy, the teed-out element 570 in the direction of the spreading of the X-ray photons 522 leaving through it is equipped with a filter element 520 which was treated in details in connection with the FIGS. 2 and 3. As a matter of fact, the feed-out element 570 constitutes an outlet window of special design achieved as a separate structural unit. In order to ensure the usability of the X-ray photons 522 starting backwards, for this embodiment the thickness of the anode material 514 and the thickness of the wall 515 (as well as the sheath also applied in the actual case) will be selected in a way (according to the transmission curves as illustrated in FIG. 1) that the X-ray photons coming out forward from the anode focal spot can be absorbed by the whole of the anode material 514 and the wall 515 (and the sheath). For another possible embodiment of the X-ray source 510, the discharge of the X-ray photons coming out forward from the anode focal spot through the outlet windows formed in the wall 515 can also be ensured. The embodiment of the X-ray source 510 is suitable for the production of an X-ray beam spreading in two different and usually optionally selected directions.

Figure 6:
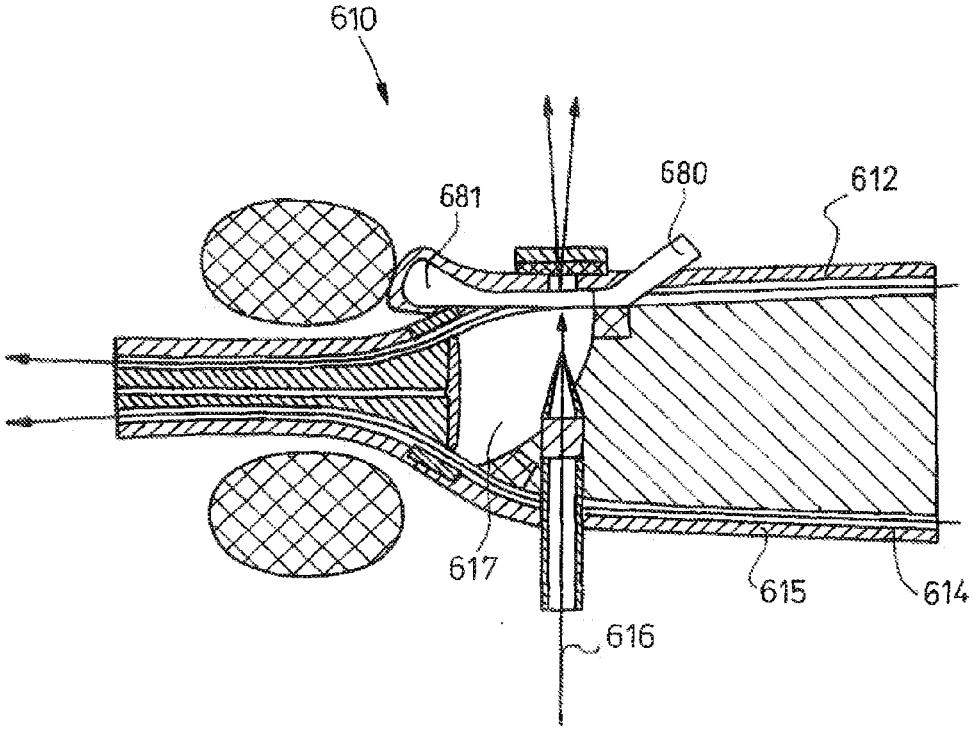
FIG. 6 is a cross-sectional view of an exemplary embodiment of a liquid anode radiation source.

For implementation of the radiation sources described in the current disclosure, it is advantageous from the aspect of heat removal if the flow rate of the anode material is relatively high. However, in order to achieve this for the entire amount of anode material, the circulation unit should provide extremely high supply pressures. Therefore, it is much simpler and economical if the anode material has a relatively high flow rate only locally, in the region of the anode focal spot. For this purpose, the liquid anode X-ray source 610 in FIG. 6 is equipped with high-pressure inlet 680. The inlet 680 is fixed in a gas-tight arrangement through the opening formed in wall 615 of body 612 of X-ray source 610 in a way that its end found within the wall 615 opens just towards the anode focal spot that is the area of the anode material 614 bombed by the source beam 616. In order to avoid the damage or deformation of the wall 615 under the effect of the supplied anode material 614, the inlet 680 is formed with a slow-motion space part 681 of special shape. The space part 681 will ensure that after leaving the anode focal spot the anode material 614 supplied at high pressure and high speed through the inlet 680 can slow down to a rate approximating the anode material flow rate otherwise achieved in the anode space 17.

The supply end of inlet 680 found outside the wall 615 is connected through a high-pressure pump (not shown) to the bowl containing the anode material 614. In one of its preferred embodiments, the bowl is constituted by the flow path containing the anode material 614 in a closed circuit or a part of it. Through the inlet 680, in the region of the anode focal spot, the anode material will be supplied at a flow rate greater that the flow rate in the anode focal spot, thereby the heat removal achieved on the anode focal spot and its direct vicinity will improve.

According to the above, if the performance of the source beam is adjusted to about 100 kW for a version of the X-ray source 610 applied in practice and the accelerating voltage is selected to 140 kV and we assume that about 60 μm thick gallium layer will evaporate (Ga boiling point is 2,205° C.) under the effect of the source beam on the anode focal spot of 0.3 mm size of the X-ray source 610, then the flow rate of the high-speed liquid flow supplied through the inlet 680 will be about 210 m/s. The supply pressure necessary for producing this flow rate is about 1,330 bar, while the volume flow is 3.78 ml/s. The concerned flow parameter values fall within the operating range of the feed pumps used in the industry, in this regard see e.g., David A. Summers's "*Waterjetting Technology*" (ISBN0419196609), page 33, second paragraph. The limit rate of the laminar flow of the anode material 614 constituted by the liquid Ga of 200° C. flowing typically in a layer of about 0.1 mm thickness on the internal surface of the wall 615 is about 5 m/s. In addition, in such an arrangement the extent of the concave bend necessary in the arched region of the wall 615 is equal to the bend of the relevant arch of a circle of not more than about 100 mm radius. We note that if an X-ray source having such parameters is assembled in the place of a rotating-anode X-ray source of a traditional X-ray apparatus (e.g. CT, μ-CT, X-ray device, mammography), then practically unchanged exposure parameters can be achieved, however, instead of the 0.9 mm focal spot of the traditionally used X-ray source using a focal spot as little as 0.3 mm, which can be considered a significant reduction with regard to the size of the focal spot. What's more, the surface of the anode material is perpendicular to the outlet direction of the X-ray photons; it is not canted. In accordance with this, from the viewpoint of usability in practice, owing to the smaller focal spot, the image quality of the X-ray devices equipped with such X-ray source will improve on the one hand, and owing to the usable greater maximum tube currents it will be sufficient to use shorter exposure times, as a result of which e.g. the probability of the appearance of artifacts originating from the movements will reduce during the imaging. This latter advantage can be utilized mainly for CT and dual energy examinations as well as during the preparation of other X-ray images.

Figure 7A:
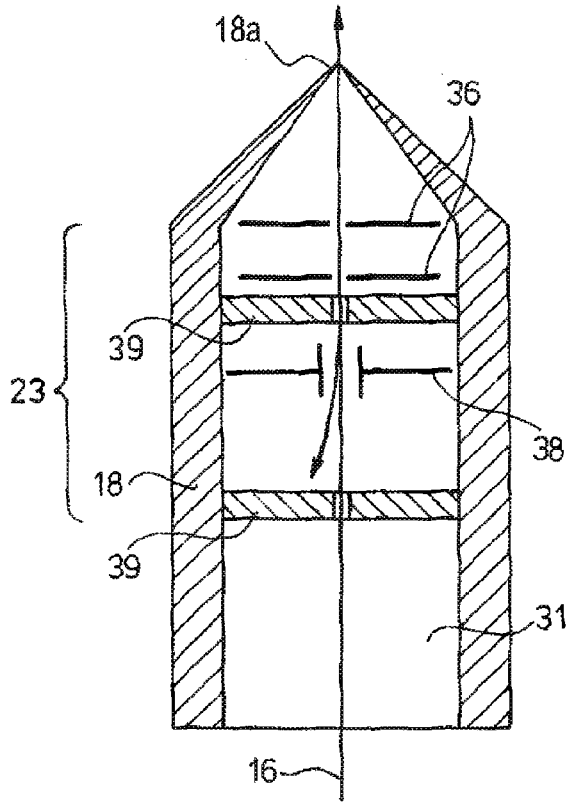
FIG. 7A is a schematic diagram viewed in cross-section of an advantageous embodiment of an anode material trap and a source beam for a radiation source.
Figure 7B:
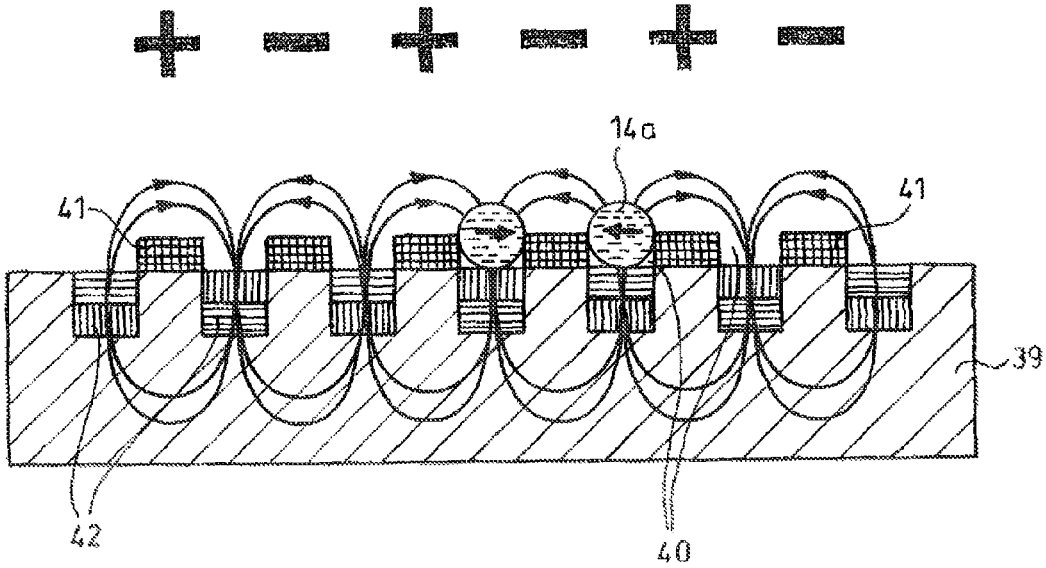
FIG. 7B is a schematic diagram viewed in cross-section of an advantageous embodiment of an anode material trap and applying a static electric field, hindering the high-voltage accelerating space from becoming contaminated with vapor of anode material.

In connection with FIG. 2, to prevent the anode material vapor from getting into the exciting unit and thus the high-voltage accelerating space applied in it, the exciting unit can be completed with an anode trap of electrostatic pump, as shown e.g., in FIG. 2 for the X-ray source 10. Such an anode material trap 23 is shown in FIG. 7*a* in an enlarged cross-sectional image. The point of it is that in the exciting unit 18, possibly in the vicinity of its outlet opening 18*a* intruding into the anode space, at a given distance from each other, the pair of the first capacitors 36 and at least one pair of capacitors 38 being the second beyond these when considered in the direction of the source of the source beam 16, are placed along the route of the source beam 16. The task of the first capacitors 36 is to decrease the kinetic energy of the particles of the anode material vapor getting into the exciting unit 18. In accordance with this, slow-down space is produced between the plates of the capacitors 36. The role of the second capacitors 38 is to divert the anode material particles slowed down in this way from the route of the source beam 16 and thereby prevent these particles from getting into the high-voltage accelerating space 31. The anode material particles diverted from the path of the source beam 16 will be filtered out by the walls 39 standing in the anode material trap 23 in perpendicular position to the course direction of the source beam 16 and constituting mechanical filter elements letting the source beam 16 through the openings of suitable size. The anode material condensed on the surface of the walls 39 will be returned into the closed liquid circuit serving the circulation of the anode material by a suitable mechanism. The trap regions containing the diverting (second) capacitors 38 are properly applied alternately with opposite polarity along the source beam 16, so in the event of using source beam 16 consisting of electrically charged particles, the non-required diversion of source beam 16 can be minimized or the capacitors 38 themselves can be used also for the possible focusing of the source beam 16.

Such a mechanism can be a network consisting of pairs of free conductors 41 printed on the surfaces of walls 39, on which an established anode material drop 14*a* causing short-circuit can be collected through the connection of an external magnetic field to it, and can be moved out from the anode material trap 23. One possible embodiment of the mentioned network is shown in 7B in cross-sectional view. In the regions 40 between the conductors 41 of alternating polarity, permanent magnets 42 are placed with polar position complying with the polarity of conductors 41. Owing to the harmonization of the polarity of conductors 41 and polar position of the intermediate magnets 42, force of the same direction will effect on the anode material drop 14*a* which appears in the regions 40 running between the pairs of conductors 41 neighboring each other and causes short-circuit, and this force will turn the anode drops 14*a* from the regions 40 spreading on two opposite sides of a conductor 41 to the conductor 41.

A magnetic field of similar structure (and thus effect) can be created if current of appropriate direction (that is alternating for each pair) flows in the further conductors (not shown) spreading in parallel with the conductors 41 in an electrically insulated way below the conductors 41 found on the surface. These conductors can also be used for the regulation of the temperature of the surface, with them the temperature of the surface can be increased above the melting point of the anode material if necessary.

Figure 8:
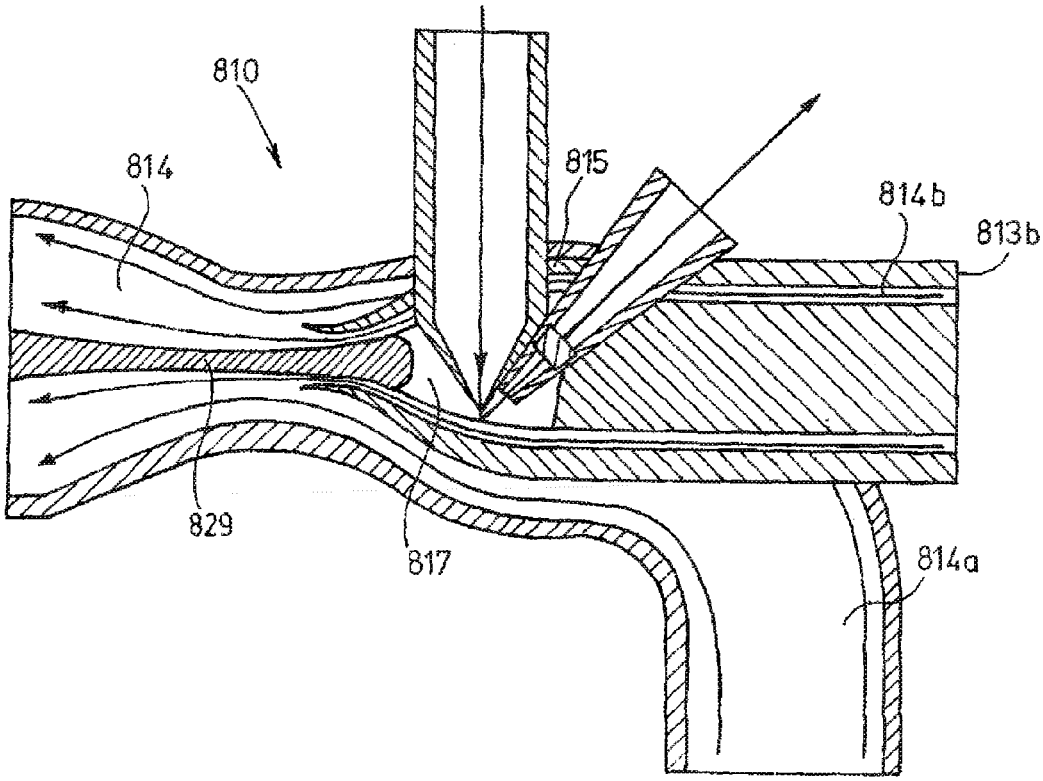
FIG. 8 is a cross-sectional view of an exemplary embodiment of a liquid anode radiation source which hinders the flowing back of anode material with an outlet of suitable geometry instead of the Faraday pump.
Figure 9:
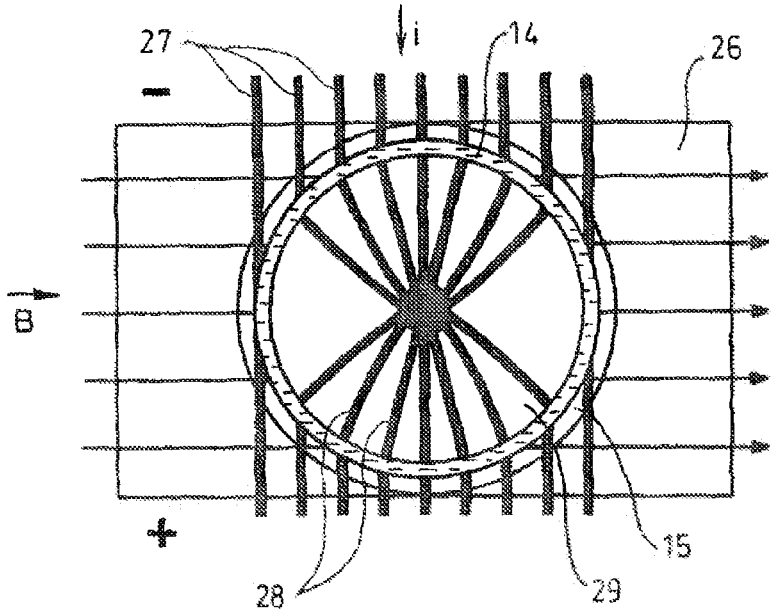
FIG. 9 is a schematic diagram viewed in section perpendicular to the flow direction of the Faraday pump applicable in the radiation source, when seen from the anode space.

FIG. 8 shows an X-ray source 810 in longitudinal section schematically which, instead of the electromagnetic pump, intends to prevent the flowing back of the anode material 814 by appropriate geometric design. The point of it is that the anode material 814 flowed in the closed liquid course by the circulating unit is properly divided into two parts (see the flow lines shown in FIG. 8), and the anode material flow 814*a* gained this way is moved outside the anode space 817, then, unifying it by appropriate geometry with the other anode material flow 814*b*, led through the anode space 817 along the internal surface of the wall 815 limiting the anode space 817, produce hydrodynamic conditions which prevent the anode material 814 from flowing back into the anode space 817. The operation of the applied geometric design is principally the same as the operation of the diffuser known from literature. The dynamic pressure of a high-speed liquid flow can be transformed into static pressure in a pipe section of expanding cross-section by decreasing the flow rate. This increased static pressure may exceed the value of the static pressure prevailing on the end 813*b*, so the high-speed flow will be able to hinder the anode material 814 from flowing back into the anode space 817, and suction force will start at the meeting of the anode material flows 814*a*, 814*b*. The flowing parameters of the anode material flow 814*a* moved outside the anode space 817 will be independent of the anode material flow 814*b* passing through the anode space 817, so the flowing back of the anode material 817 with any orientation of the X-ray source 810 can be hindered even in the event of greater storage tank pressures. For another preferred embodiment of the X-ray source 810, the chance of flowing back of the anode material 814 into the anode space 817 can be decreased by means of a deflector 829 of similar design as the mechanical deflector 29 of the pump 25 shown in FIG. 2 and arranged in the outlet of the X-ray source 810 in a position uniaxial with it.

The X-ray source described in connection with FIGS. 2 to 9 serve only as the illustration of the concept of the invention and further liquid anode radiation sources can be achieved if the special characteristics of the described embodiments are combined with each other, without exceeding the scope of the protection claimed. Furthermore, numerous modifications of the liquid anode radiation sources as per the current disclosure described in details previously are possible, without exceeding the scope of the protection claimed. Especially, the exiting beam can be moved into the anode space through any point of the body, so even through the restriction or the deflector. In addition, it is also obvious that the versions of the radiation sources as per the invention equipped with electromagnetic pump can also be operated in a stable way even with the flow of the anode material achieved in a reversed direction that is from the narrowing part of the body to the wider part of the body.

While the disclosure has been described with reference to various embodiments, those skilled in the art will appreciate that certain substitutions, alterations and omissions may be made to the embodiments without departing from the spirit of the disclosure. Accordingly, the foregoing description is meant to be exemplary only, and should not limit the scope of the disclosure as set forth in the following claims.

What is claimed is:

1. A liquid anode radiation source comprising:

a body having a wall limiting the anode space equipped with inlet and outlet, where the outlet connected to the inlet outside the body will define a continuous flow path closing through the body, the inlet has a wall limiting an internal cross-section changing towards the anode space, where in the cross-section of the inlet a deflector is arranged in a position free of contacting the wall, filling out the cross-section partially and movable to the direction perpendicular to the cross-section;

a liquid anode material arranged in the flow path;

a circulation unit inserted in the flow path in a way that it can ensure the unidirectional movement of the anode material in the flow path;

an exciting unit having an outlet opening arranged in a way that it can emit a source beam of specified energy to the assigned region of the anode material;

a feed-out element established in a way that it can move out the radiation started by the source beam in the assigned region of the anode material for the purpose of using it, wherein a wall limiting the anode space is concavely arched at least one region of its contact surface and thereby the radiation source is formed as an anode holder in its operating status starting inertial force on the anode material flowing in the considered region thereby pressing the anode material onto the surface, where the assigned region of the liquid anode material irradiated with the source beam is placed in such a way that it can cover at least partially the concavely arched region of the anode focal spot, anode space;

the exciting unit can freely communicate with the anode space by an outlet opening, further comprising:

a structure stabilizing the flow of the liquid anode material is placed in the anode space between the considered arched region and the outlet.

2. The radiation source of claim 1, wherein the structure stabilizing the flow of the anode material is an electromagnetic pump, which has at least one electrically insulated middle electrode arranged in the outlet, at least on external electrode embedded in the wall of the body between the arched region and the outlet in an electrically insulated way, as well as an element suitable for starting a magnetic field between the arched region and the outlet, placed outside the body and in a way at least partially surrounding it.

3. The radiation source of claim 2, wherein the at least one middle electrode constitutes the part of a mechanical deflector arranged in the outlet and having a design which can contribute to the flow of the anode material along the wall and having an end intruding into the anode space.

4. The radiation source of claim 3, wherein the at least one middle electrode is placed on the surface of the end of the deflector viewing towards the anode space, defining a geometry together with the at least one external electrode in which in the operating status of the radiation source the direction of the magnetic field started by the at least one element suitable for generating magnetic field as well as the direction of the current flowing through the anode material between the external and middle electrodes are practically perpendicular to each other between the arched region and the outlet.

5. The radiation source of claim 1, wherein the structure stabilizing the flow of the anode material is constituted by the outlet of the anode space established as a diffuser and in the operating status of the radiation source is surrounded externally by a circumfluent part of the anode material flowing in the radiation source.

6. The radiation source of claim 5, further comprising a mechanical deflector having an end intruding into the anode space formed in a way that it can contribute to the flow of the residue of the anode material along the wall.

7. The radiation source of claim 6, wherein the mechanical deflector is arranged in the outlet in a position uniaxial with its wall.

8. The radiation source of claim 1, wherein the feed-out element comprises at least one of:

an outlet window constituting integral part of the wall, made of a material having radiation permeability exceeding the radiation permeability of the wall which will move out the radiation having also a speed component of the same direction as the spreading direction of the source beam in a cone region of a given angle around the direction of the source beam entering the anode material as axis from the anode space; and an outlet element passing through the wall and ensuring gas-tight closure with the wall in the place of passing-through, which will move out the radiation having also a speed component of a direction opposite to the spreading direction of the source beam in a cone region of a given angle from the anode space.

9. The radiation source of claim 1, further comprising a restriction that is established in a way that it can be interlocked in an optional position.

10. The radiation source of claim 9, wherein the restriction has at least one actuating element, which is established in a way that it can start the longitudinal displacement and interlocking in the required position of the restriction as a reply to the control signal produced by using at least the value of the required thickness measured in real time of the anode material flowing on the anode focal spot.

11. The radiation source of claim 10, further comprising a light source placed in the anode space exposing the anode material, preferably on the anode focal spot, as well as a detector placed in the anode space and detecting the light distribution formed in reply to the exposure on the surface of the anode material, furthermore electronics connected electrically to the detector and producing the control signal by processing the light distribution.

12. The radiation source of claim 11, wherein the light source is fixed at the end of the deflector intruding into the anode space, while the detector on the surface of the restriction viewing towards the anode space.

13. The radiation source of claim 11, wherein the light source is fixed on the surface of the restriction viewing towards the anode space, while the detector at the end of the deflector intruding into the anode space.

14. The radiation source of claim 1, wherein the exciting unit has an anode material trap filtering out the particles of the anode material entering the exciting unit, which is arranged between the outlet opening of the exciting unit and the high-voltage accelerating space constituting part of the source of the source beam.

15. The radiation source of claim 14, wherein the anode material trap includes a slow-down electrostatic field, diverting electrostatic field and at least one mechanical filter element following each other when moving from the outlet opening towards the source of the source beam.

16. The radiation source of claim 15, wherein the at least one mechanical filter element is designed in a way that it can collect the anode material filtered by it and supply it to the continuous flow path.

17. The radiation source of claim 1, wherein the body has an inlet which opens to the anode focal spot and ensures high-pressure and high-speed anode material supply from outside the body.

18. The radiation source of claim 1, wherein the liquid anode material is any of liquid gallium or gallium alloy or liquid mercury or mercury alloy and the source beam is an electron beam.

19. The radiation source of claim 1, wherein the liquid anode material is lead melt and the source beam is a proton beam.

20. The radiation source of claim 1, wherein the liquid anode material is comprised by liquid gallium or gallium alloy, liquid mercury or mercury alloy, while the source beam is a beam of electrically charged particles.

* * * * *